US009049910B1

(12) United States Patent
Bakali

(10) Patent No.: US 9,049,910 B1
(45) Date of Patent: Jun. 9, 2015

(54) CARRY BAG ASSEMBLY WITH DETACHABLE SECONDARY POUCHES FOR USE WHEN WALKING A PET

(71) Applicant: Brenda A. Bakali, Philadelphia, PA (US)

(72) Inventor: Brenda A. Bakali, Philadelphia, PA (US)

( * ) Notice: Subject to any disclaimer, the term of this patent is extended or adjusted under 35 U.S.C. 154(b) by 0 days.

(21) Appl. No.: 13/937,233

(22) Filed: Jul. 9, 2013

(51) Int. Cl.

| | |
|---|---|
| ***B65D 30/00*** | (2006.01) |
| ***B65D 30/22*** | (2006.01) |
| ***B65D 33/28*** | (2006.01) |
| ***B65D 30/04*** | (2006.01) |
| ***B65D 30/06*** | (2006.01) |
| ***A45C 1/02*** | (2006.01) |
| ***A45C 3/06*** | (2006.01) |
| ***A45C 11/00*** | (2006.01) |

(52) U.S. Cl.
CPC ..... *A45C 11/00* (2013.01)

(58) Field of Classification Search
CPC ..... A45C 3/06
USPC ..... 383/38, 40, 4, 117, 72, 75, 37; 150/112–114, 103–105, 117
See application file for complete search history.

(56) References Cited

U.S. PATENT DOCUMENTS

| | | | | | |
|---|---|---|---|---|---|
| 1,560,223 | A | * | 11/1925 | Englander | 150/106 |
| 1,887,511 | A | * | 11/1932 | Maksik | 150/117 |
| 1,959,675 | A | * | 5/1934 | Hogg | 150/117 |
| 2,223,029 | A | * | 11/1940 | Dunton | 2/160 |
| 2,316,328 | A | * | 4/1943 | Guenther et al. | 190/124 |
| 2,612,199 | A | * | 9/1952 | Schocket | 150/112 |
| 3,955,609 | A | * | 5/1976 | Siegel | 150/117 |
| 3,958,616 | A | * | 5/1976 | Beverstock | 150/102 |
| 4,050,493 | A | * | 9/1977 | Cho | 150/106 |
| 4,301,898 | A | * | 11/1981 | Plough et al. | 190/102 |
| 5,007,470 | A | * | 4/1991 | Freeman | 150/114 |
| 5,197,525 | A | * | 3/1993 | Cantor | 150/102 |
| 5,544,745 | A | * | 8/1996 | Famorca | 206/320 |
| D438,375 | S | * | 3/2001 | Terry | D3/233 |
| 6,199,737 | B1 | | 3/2001 | Ringelstetter | |
| 6,206,567 | B1 | * | 3/2001 | Cyr | 383/29 |
| 6,257,473 | B1 | | 7/2001 | Ringelstetter | |
| 6,637,484 | B1 | * | 10/2003 | Kraft | 150/112 |
| 6,637,485 | B1 | * | 10/2003 | Sartena | 150/118 |
| 6,668,882 | B1 | * | 12/2003 | Cazes | 150/104 |
| 6,994,131 | B2 | * | 2/2006 | Dedmon | 150/106 |
| 2008/0006354 | A1 | * | 1/2008 | Lang | 150/105 |

* cited by examiner

*Primary Examiner* — Jes F Pascua
(74) *Attorney, Agent, or Firm* — LaMorte & Associates, P.C.

(57) ABSTRACT

A carry bag assembly having a primary bag structure. The interior is accessible through an open top. At least one flap is provided outside the primary bag structure. Each flap hangs freely next to the primary bag structure, therein defining a veiled area between the flap and the primary bag structure. A removable pouch is provided for each veiled area. A connector is disposed between each removable pouch and the primary bag structure for use in selectively connecting the removable pouch to the primary bag structure. Each removable pouch attaches to the primary bag structure within a veiled area behind a flap. In this manner, the removable pouches can be attached to the exterior of the primary bag structure without being viewed by an observer.

17 Claims, 3 Drawing Sheets

CARRY BAG ASSEMBLY WITH DETACHABLE SECONDARY POUCHES FOR USE WHEN WALKING A PET

BACKGROUND OF THE INVENTION

1. Field of the Invention

In general, the present invention relates to specialized carry bags. More particularly, the present invention relates to carry bags that are specialized for use when walking a dog or similar pet.

2. Prior Art Description

Many pet owners live in neighborhoods and communities where they are required to walk their pets on property that is not their own. For example, people who live in cities have little choice but to walk their pets on public streets and/or in public parks.

Many municipalities have ordinances that require pet owners to clean up the waste excreted by their pets if such waste is not on the pet owner's land. It is for this reason that many pet owners carry plastic bags with them as they walk their pets. Should a pet create waste, the pet owner scoops the waste into the plastic bag and carries the plastic bag to the nearest trash receptacle. The problem is that trash receptacles are not always available. As a result, a pet owner is often required to carry the bag full of waste for substantial periods of time before that bag can be discarded.

Carrying bags of pet waste for any period of time is both unpleasant and potentially unsanitary. Low quality plastic bags are often used to pick up and hold waste. The most common bag selected for the job is a recycled plastic grocery bag. Such bags often have small holes in them that make it impossible to hermetically seal the waste. As such, bags of pet waste inevitably smell and can be the sources of fecal contamination and diseases carried by fecal contamination.

Recognizing that it is unsightly, unpleasant and potentially harmful to carry bags filled with pet waste, carry bags have been created in the prior art that are designed to hold filled bags of pet waste. Such prior art devices are exemplified by U.S. Pat. No. 6,199,737 to Ringelstetter, entitled Sanitary Animal Waste Collection Holder, and U.S. Pat. No. 6,257,473 to Ringelstetter, entitled Sanitary Collection Holder For Animal Waste. Such prior art bags disclose traditional shoulder-strap carry bags. Filled bags of pet waste are placed inside the carry bags and the bags are closed. In this manner, the bags of waste are out of sight and are less likely to be smelled. However, as has been previously mentioned, pet waste is often picked up using low quality grocery bags. Such bags are not sanitary and enable fecal contamination to seep to the exterior of the bag. This fecal contamination is then transferred to the interior surfaces of the carry bag as the bag is agitated. The result is a carry bag having an interior contaminated with fecal bacteria. These bacteria will contaminate anything and everything placed inside the carry bag, even after the pet waste is removed. The result is that the carry bag is unsafe to use for carrying dog leashes, extra bags, pet treats, or any of the many other items a pet owner may bring on a walk.

A need therefore exists for a carry bag for a pet owner, that enables a pet owner to collect, store and conceal bags of pet waste, without contaminating the interior of the carry bag. This need is met by the present invention assembly as described and claimed below.

SUMMARY OF THE INVENTION

The present invention is a carry bag assembly for a pet owner or a professional pet walker who walks a pet and is responsible for cleaning up after the pet. The carry bag assembly has a primary bag structure that defines an enclosed interior. The interior is accessible through an open top. At least one flap is provided outside the primary bag structure. Each flap has a top end that attaches to the primary bag structure or to the handle of the primary bag structure. Each flap hangs freely next to the primary bag structure, therein defining a veiled area between said flap and the primary bag structure.

A removable pouch is provided for each veiled area. As such, the number of removable pouches corresponds to the number of flaps. A connector is disposed between each removable pouch and the primary bag structure for use in selectively connecting the removable pouch to the primary bag structure. Each removable pouch attaches to the primary bag structure within a veiled area behind a flap. In this manner, the removable pouches can be attached to the exterior of the primary bag structure without being viewed by an observer. Consequently, if pet waste is held within a removable pouch, the waste can be carried with the primary bag structure without contaminating the interior of the primary bag structure while remaining hidden from site behind a flap.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention carry bag assembly can be embodied in many ways and used for many purposes, the embodiment illustrated shows the carry bag assembly being used to hold and conceal plastic bags of pet waste. This embodiment is selected in order to set forth the best mode contemplated for the invention. The illustrated embodiment, however, is merely exemplary and should not be considered a limitation when interpreting the scope of the appended claims.

Figure 1:
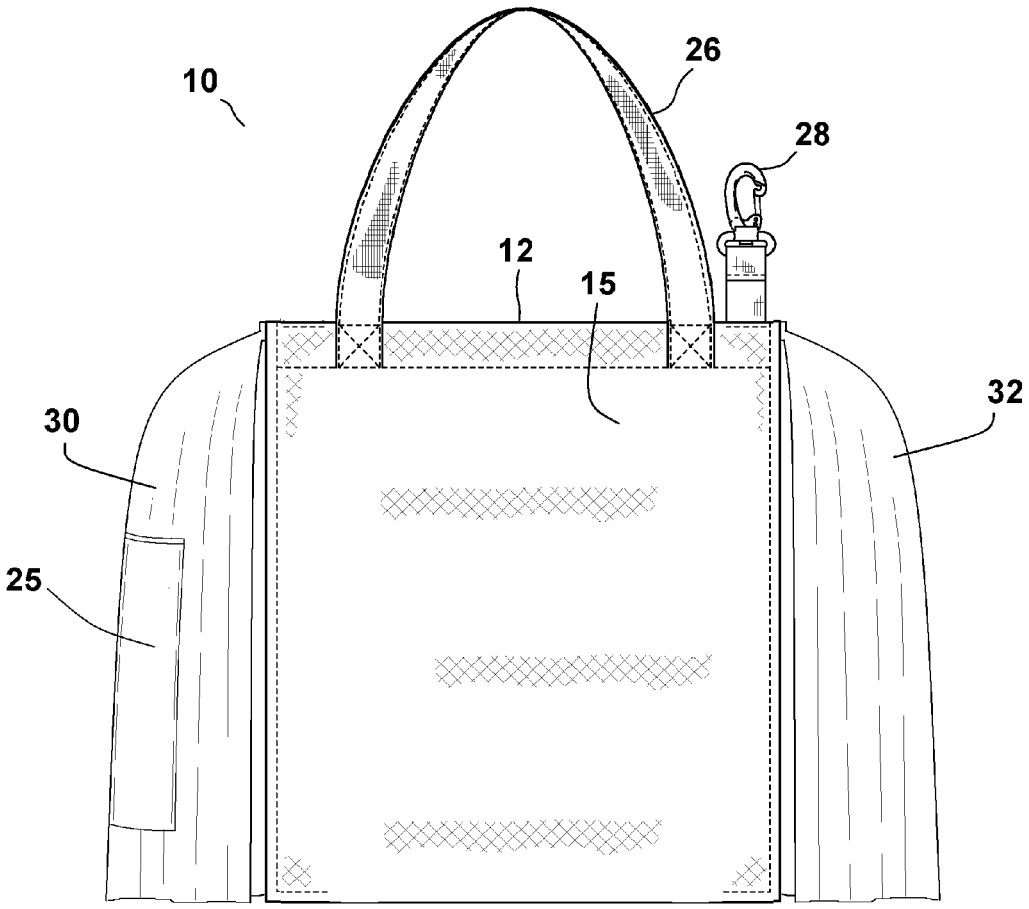
FIG. 1 is a front view of an exemplary embodiment of a carry bag assembly.
Figure 2:
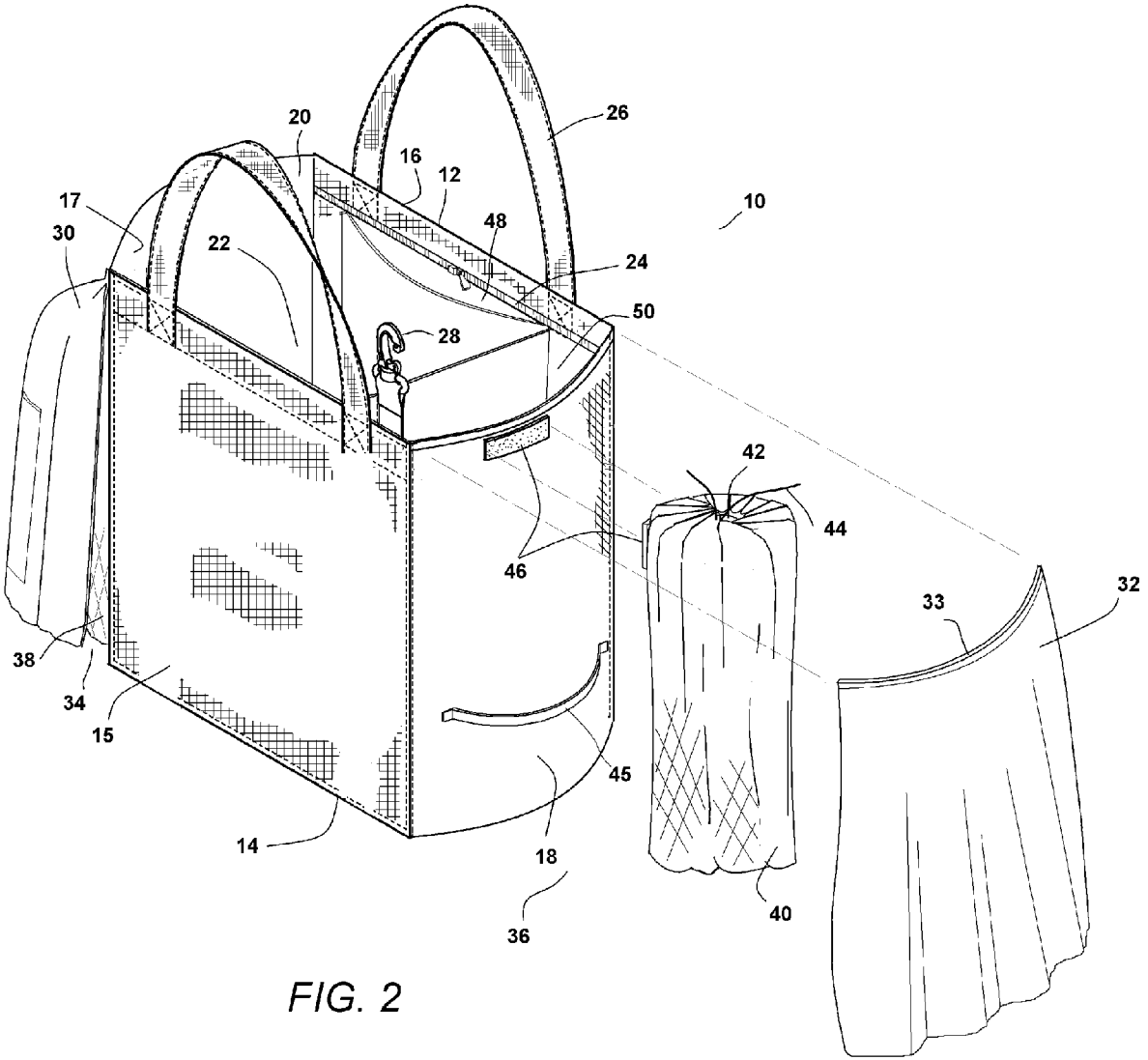
FIG. 2 is a partially exploded perspective view of the carry bag assembly shown in FIG. 1.

Referring to FIG. 1 in conjunction with FIG. 2, a carry bag assembly 10 is shown. The carry bag assembly 10 includes a primary bag structure 12. The primary bag structure 12 has a closed bottom 14, closed side panels 15, 16, 17, 18 and an open top 20. The closed bottom 14 and the side panels 15, 16, 17, 18 define an interior 22. In the shown embodiment, the primary bag structure 12 is generally rectangular in shape. However, it should be understood that the primary bag structure 12 can have many other shapes, provided it defines an isolated interior.

A top closure 24, such as a zipper or snaps may be disposed near the open top 20 so that the open top 20 can be selectively opened and closed. The interior 22 of the primary bag structure 12 is accessed through the open top 20 when the top closure 24 is open. When the top closure 24 is closed, the interior 22 of the primary bag structure 12 is isolated.

The side panels of the primary bag assembly include a front panel 15, a rear panel 16 and two opposite end panels 17, 18. Handle straps 26 are sewn to both the front panel 15 and the rear panel 16. The length of the handle straps 26 is a matter of design choice. The handle straps 26 are used to manually grasp the overall carry bag assembly 10.

A hook 28 is attached to the primary bag structure 12. The hook 28 is preferably attached to the primary bag structure 12 near or at the position where the handle strap 26 is sewn to the primary bag structure 12. Such a position is reinforced by stitching and ensures that the hook 28 cannot be easily torn away from the overall carry bag assembly 10. The hook 28 can be either metal or plastic. The hook 28 is large enough to mechanically engage the handle loop of a pet leash (not shown). In this manner, using the hook 28, a pet leash can be selectively attached to the carry bag assembly 10. A user can, therefore, attach a leashed pet to the carry bag assembly 10 and walk the pet by only gripping the carry bag assembly 10.

Two flaps 30, 32 are provided. The flaps 30, 32 attach to the end panels 17, 18 of the primary bag structure 12. Each of the flaps 30, 32 has a top edge 33. The flaps 30, 32 are opaque and are preferably made of fabric that compliments the theme selected for the primary bag structure 12. The flaps 30, 32 have a length that is at least as long as the end panels 17, 18 of the primary bag structure 12. The top edges 33 of the flaps 30, 32 are attached to the end panels 17, 18 of the primary bag structure 12 near the open top 20 of the primary bag structure 12. The attachment of the flaps 30, 32 can be made using permanent sewn seams. However, a removable attachment device is preferred, such as snaps, buttons or hook and loop material. On optional cell phone pocket 25 can be formed on one or both of the flaps 30, 32.

The flap 30, 32 are preferably slightly oversized so they billow and flop to the sides of the primary bag structure 12. This presents the overall carry bag assembly 10 with the appearance of having two floppy side ears. This promotes the overall pet theme of the carry bag assembly 10. In fact, decorations can be added to the front panel 15 of the primary bag structure 12 to enhance its resemblance to a pet's face.

Due to the oversized nature of both the first flap 30 and the second flap 32, two veiled areas 34, 36 exist between the flaps 30, 32 and the end panels 17, 18 of the primary bag structure 12. The veiled areas 34, 36 cannot be seen through the material of the flaps 30, 32. However, the veiled areas 34, 36 are easily accessed by simply pushing the flaps aside.

Two removable pouches 38, 40 are provided. Each of the removable pouches 38, 40 are preferably made of a non-absorbent synthetic mesh material, such as nylon mesh or polypropylene mesh. Furthermore, the removable pouches 38, 40 are preferably drawstring pouches, wherein the removable pouches 38, 40 have open tops 42 that can be drawn closed by the pulling of a drawstring 44.

The removable pouches 38, 40 attach to the end panels 17, 18 of the primary bag structure 12, under the flaps 30, 32 and within the veiled areas 34, 36. Attachment is achieved using a mechanical connector 46, such as snaps, magnets, or hook and loop material. Half of the connector 46 is attached to a removable pouch. The other half of the connector 46 is attached to an end panel 17, 18 of the primary bag structure 12.

Optional elastic loops 45 can be affixed to each end panel 17, 18 to help retain the removable pouches 38, 40 in place. The removable pouches 38, 40 are sized to fit within the veiled areas 34, 36 under the flaps 30, 32. As such, the presence of the flaps 30, 32 prevents the removable pouches 38, 40 from being seen. Furthermore, since the removable pouches 38, 40 move freely in the veiled areas 34, 36, they only incidentally contact the material of the flaps 30, 32 and the end panels 17, 18.

A plurality of pockets 48 and/or compartments 50 can be formed within the interior of the primary bag structure 12. The pockets 48 and compartments 50 can be used to hold leashes, bottles of water, pet food, pet snacks, and the like. Regardless of the objects that are held within the interior 22 of the primary bag structure 12, these objects are isolated from the surrounding environment and are kept sanitary by the top closure 24 of the primary bag structure 12. In the illustrated embodiment, the top closure 24 is shown as a simple zipper closure. It will be understood that the top closure could involve the use of a folding flap that folds over the open top 20 of the primary bag structure 12. Such a folding flap can be decorated in the theme of a pet's face to complement the appearance of pet ears provided by the side flaps 30, 32.

Figure 3:
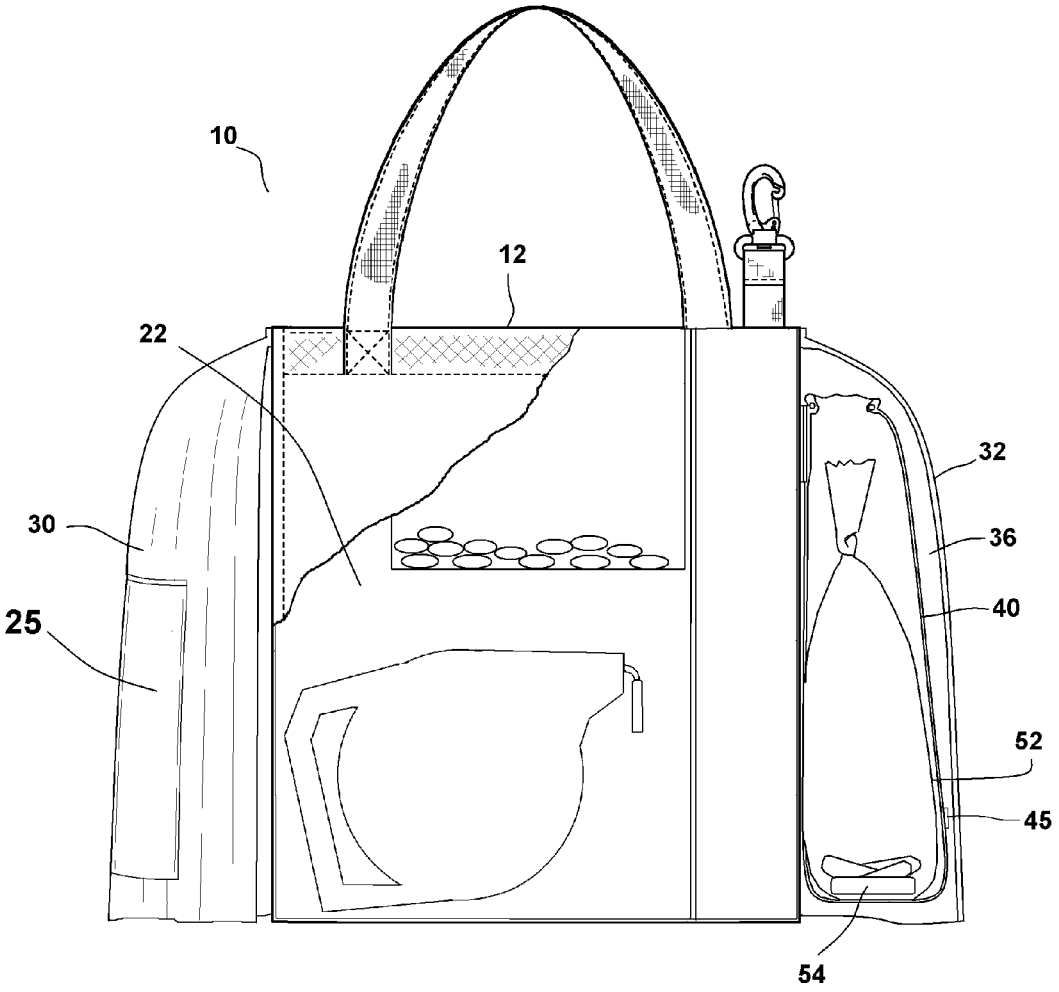
FIG. 3 is a front cross-sectional view of the carry bag assembly shown in conjunction with a plastic bag of waste.

Referring to FIG. 3 in conjunction with FIG. 1 and FIG. 2, the uses of the various described components can be better understood. The carry bag assembly 10 is taken by a pet owner when a pet is walked. Any items, such as leashes, snacks, and food are packed and carried within the interior 22 of the primary bag structure 12. In addition, the pet owner stores one or more plastic bags should the pet produce waste during the walk.

If the pet produces waste, the plastic bag 52 is removed and the waste 54 is captured. The plastic bag 52 is tied closed and placed inside one of the removable pouches 40. This can be done remotely by separating one of the removable pouches 40 from the carry bag assembly 10. Once the plastic bag 52 is inside one of the removable pouches 40, the removable pouch 40 is attached to the primary bag structure 12 within the veiled area 36 behind a flap 32. The flap 32 is then positioned over the removable pouch 40.

The removable pouch 40 is attached to the primary bag structure 12 but always remains outside the primary bag structure 12. In this manner, the interior 22 of the primary bag structure 12 always remains sanitary. An observer looking at the overall carry bag assembly 10 will not see the removable pouch 40 or its contents. Rather, an observer will only see the primary bag structure 12 with the side flaps 30, 32. The person holding the carry bag assembly 10, therefore, need not be concerned of being seen carrying pet waste 54.

To remove the pet waste 54, the removable pouch 40 is detached from the primary bag structure 12 and removed from the veiled area 36. The removable pouch 40 is then opened and the plastic bag 52 of pet waste 54 removed. Should the removable pouch 40 require cleaning, the removable pouch 40 can be washed, rinsed or otherwise laundered before it is reattached to the primary bag structure 12. Since the removable pouch 40 is made of non-absorbent materials, the removable pouch 40 does not absorb moisture and does not require drying other than a few shakes to free clinging water. Likewise, if the flaps 30, 32 were ever to require laundering, they also can be removed from the carry bag assembly 10 and laundered.

It will be understood that the embodiment of the present invention that is illustrated and described is merely exemplary and that a person skilled in the art can make many variations to that embodiment. For instance, in the shown embodiment, two flaps and two removable pouches are shown. It should be understood that the carry bag assembly can be produced that has only one flap and one removable pouch, or a plurality of flaps and a plurality of removable pouches. Two flaps are used in the exemplary embodiment simply because it enables the carry bag assembly to have the appearance of a pet face. Likewise, in the shown embodiment, the flaps attach to the end panels of the primary bag structure. It should be understood that the flaps can be attached to the primary bag structure at other points, such as the handles. What is important is that each flap hangs freely over a portion of the primary bag structure. All such embodiments are intended to be included within the scope of the present invention as defined by the claims.

What is claimed is:

1. A carry bag assembly, comprising:

a primary bag structure that defines an enclosed interior that is accessible through an open top, said primary bag having a front panel, a rear panel and end panels that extend between said front panel and said rear panel;

a first flap having a top end that is coupled to a first of said end panels of said primary bag structure, wherein said first flap billows and flops next to said first of said end panels of said primary bag structure, therein defining a veiled area with an open bottom between said first flap and said first of said end panels of said primary bag structure;

a removable pouch of synthetic mesh material that has a pull-string closure; and a connector disposed between said removable pouch and said first of said end panels of said primary bag structure for selectively connecting said removable pouch to said primary bag structure within said veiled area between said primary bag structure and said first flap, wherein said removable pouch is suspended above said open bottom of said veiled area.

2. The assembly according to claim 1, wherein said mesh fabric is non-absorbent.

3. The assembly according to claim 1, wherein said first flap attaches to said primary bag structure with a selectively detachable connector.

4. The assembly according to claim 1, further including a second flap that is attached to a second of said end panels of said primary bag structure.

5. The assembly according to claim 4, further including a second removable pouch, wherein said second removable pouch attaches to said primary bag structure behind said second flap.

6. The assembly according to claim 1, further including a hook connector coupled to said primary bag structure, wherein said hook connector extends outside said enclosed interior.

7. The assembly according to claim 1, wherein said removable pouch has a length and said first flap is at least as long as said length to veil all of said removable pouch when said removable pouch is connected to said primary bag structure in said veiled area.

8. The assembly according to claim 1, further including at least one handle attached to said primary bag structure.

9. The assembly according to claim 1, further including a plurality of compartments within said interior of said primary bag structure.

10. A carry bag assembly, comprising:

a primary bag structure that defines an enclosed interior that is accessible through an open top, said primary bag structure having a first side surface and a second side surface;

a first flap attached to said primary bag structure, wherein said first flap billows and flops freely next to said first side surface of said primary bag structure, therein defining a first veiled area with a first open bottom between said first flap and said primary bag structure;

a second flap attached to said primary bag structure, wherein said second flap billows and flops freely next to said second side surface of said primary bag structure, therein defining a second veiled area with a second open bottom between said second flap and said primary bag structure;

a first removable pouch selectively attachable to said primary bag structure in said first veiled area behind said first flap, wherein said first removable pouch is suspended above said first open bottom of said first veiled area; and a second removable pouch selectively attachable to said primary bag structure in said second veiled area behind said second flap, wherein said second removable pouch is suspended above said second open bottom of said second veiled area.

11. The assembly according to claim 10, wherein said first removable pouch and said second removable pouch are both fabricated from mesh fabric.

12. The assembly according to claim 11, wherein said mesh fabric is synthetic and non-absorbent.

13. The assembly according to claim 10, wherein said first flap and said second flap are selectively detachable and reattachable to said primary bag structure.

14. The assembly according to claim 10, further including a hook connector coupled to said primary bag structure that extends outside of said enclosed interior.

15. The assembly according to claim 10, wherein said first removable pouch has a length and said first flap is at least as long said length to veil all of said first removable pouch when said first removable pouch is connected to said primary bag structure in said first veiled area.

16. The assembly according to claim 10, further including at least one handle attached to said primary bag structure.

17. The assembly according to claim 10, further including a plurality of compartments within said interior of said primary bag structure.

* * * * *